United States Patent [19]

Bellafiore et al.

[11] 4,333,973

[45] Jun. 8, 1982

[54] INSULATING MACHINE AND PROCESS

[75] Inventors: Francis V. Bellafiore; Michael P. Duff; David M. O'Meara, all of Joliet, Ill.

[73] Assignee: Chicago Bridge & Iron Company, Oak Brook, Ill.

[21] Appl. No.: 176,185

[22] Filed: Aug. 7, 1980

[51] Int. Cl.[3] ..... B05D 1/02

[52] U.S. Cl. ..... 427/424; 118/305; 118/323; 427/421

[58] Field of Search ..... 427/421, 424, 426; 118/305, 323

[56] References Cited

U.S. PATENT DOCUMENTS 4,167,151 9/1979 Muraoka ..... 118/323 X 4,209,557 6/1980 Edwards ..... 118/323 X

FOREIGN PATENT DOCUMENTS 294996 5/1967 Australia ..... 118/323

981082 1/1976 Canada ..... 118/323

2050541 4/1972 Fed. Rep. of Germany ..... 118/323

*Primary Examiner*—Shrive P. Beck

*Attorney, Agent, or Firm*—Merriam, Marshall & Bicknell

[57] ABSTRACT

Apparatus and method for depositing a bed of polymeric insulating foam on a horizontal or sloped surface. The apparatus rolls on the surface being insulated and while it moves forward, lateral bands of insulating foam are sequentially and rapidly deposited by spraying a foamable liquid from a nozzle mounted on a carriage reciprocally moving on a track on the apparatus.

23 Claims, 16 Drawing Figures

R
F

INSULATING MACHINE AND PROCESS

This invention relates to apparatus for, and methods of, insulating objects and structures. More particularly, this invention pertains to novel apparatus for, and methods of, insulating horizontal and sloped surfaces with a bed of polymeric foamed in place insulation.

BACKGROUND OF THE INVENTION

Various kinds of insulation are used to provide thermal barriers on equipment, apparatus, buildings, vessels, tanks and other structures. One of the most useful types of insulation is produced by expanding through a spray nozzle a liquid mixture of two or more components which quickly react to form a polymeric foam. The resulting foam can be cut into slabs, blocks or other shapes and then applied to the object to be insulated. Alternatively, the foamed insulation can be applied directly in place by spraying the liquid mixture directly onto the surface to be insulated and letting it expand and solidify. Foaming in place is preferable when large surfaces are to be insulated since it eliminates extensive costly labor and provides a continuous insulating bed lacking, or having few, abutting joints through which air can flow.

When the foam is developed between two spaced apart opposing surfaces which limit expansion, such as is disclosed in Garis et al. U.S. Pat. No. 3,548,453 and Larsen U.S. Pat. No. 3,991,842 in insulating the vertical walls of cylindrical tanks, a uniform foam thickness can be readily obtained. Producing a uniformly thick foam bed on one surface, without use of a restraining means of some kind to limit foam expansion, is quite difficult. This is easily appreciated when it is noted that the liquid mixture applied to the surface generally expands from 5 to 30 times in volume before the solid foam is formed. Even though the two patents identified above show machine reciprocal spraying of the liquid composition to produce a vertical foam bed as a single layer, horizontal or sloped surfaces are generally foamed in place by a skilled workman. The work is exacting, tiring and costly. However, even an experienced sprayer is unable to deposit the foam evenly or of uniform thickness, which is not surprising since he has no way to determine immediately the liquid thickness except by judgment and experience. In addition, manual foam deposition on comparatively windy days is generally not possible because an operator is unable to simultaneously handle the foaming nozzle and a portable wind screen. A need accordingly exists for apparatus and methods which will permit the mechanical application of foamed in place insulation, particularly on horizontal or sloped surfaces, and even during relatively windy conditions.

SUMMARY OF THE INVENTION

According to the invention, there is provided an apparatus for depositing a bed of polymeric insulating foam on a horizontal or sloped surface comprising a steerable vehicle with front and rear ends having wheels adapted to roll on a horizontal or sloped surface and with drive means to propel the vehicle forward and backward; a horizontal member, mounted on one end of the vehicle, having rail means on which a carriage is mounted for horizontal reciprocal movement; means for effecting reciprocal movement of the carriage on the horizontal member; and a bracket on the carriage adapted to receive a foam spray gun for spraying a liquid composition, which quickly expands and sets into a dry polymeric insulating foam, onto a surface on which the vehicle can roll.

The vehicle can have three wheels but desirably contains four wheels, with two spaced apart wheels at each end. The wheel or wheels at one end are generally steerable so as to maneuver the vehicle and to also facilitate its use in depositing a curved insulating foam strip. The steerable wheel or wheels are usually best positioned on the vehicle end opposite the end having the horizontal member.

The apparatus includes means for effecting a substantially constant rate of reciprocal movement of the carriage on the horizontal member. The carriage and the horizontal member desirably include means for starting and stopping foam liquid spraying as the carriage reciprocates on the horizontal member. Specifically, the apparatus can include means for starting spraying when the carriage is at one location, on the horizontal member, and for stopping spraying when the carriage reaches another location on the horizontal member. Such means can provide for starting spraying only at one location and for stopping spraying only at another location, although both locations can be variable. In addition, the apparatus can include means for starting spraying at alternating ends of the reciprocal path through which the carriage can move on the horizontal member. The means for stopping spraying can terminate spraying where the means for starting spraying initiates deposition of a subsequent band of insulating foam liquid.

The horizontal member is desirably linear, and preferably straight, although it can be curvilinear.

The rail means can comprise two spaced apart parallel rails extending about the length of the horizontal member and the carriage can be supported on the rails by at least four rollers with two rollers riding on each rail. The rollers can have a radial V-groove which mates with an angled rail face on each rail.

The horizontal member, in one form of the apparatus, has a sprocket near each end and an endless chain mounted on the sprockets, power means to drive one of the sprockets, and scotch yoke means operatively connecting the chain to the carriage so that reciprocal travel of the carriage can be effected by the chain. The power means can include means to drive the sprocket at a variable rate.

The drive means to propel the vehicle forward and backward desirably includes means to vary the speed of the vehicle.

It is generally advantageous for the carriage reciprocal movement to extend beyong the wheel tracks so that in depositing adjacent foam strips the wheels will not run on the previously deposited strip. For this reason, the horizontal member can be made wider than the vehicle.

The apparatus can also include a wind screen, desirably removable, to protect the surface area being insulated against the action of the wind when the foam is being applied or deposited. This can not be done with manual deposition of foam because an operator is unable to handle a wind screen at the same time he manipulates a foam spraying nozzle.

In a second major aspect of the invention, there is provided a method of applying a bed of polymeric insulating foam which comprises spraying by means of a nozzle a liquid composition, which quickly expands and sets into a dry polymeric insulating foam, in a predetermined pattern of travel onto a horizontal or sloped surface to thereby deposit a layer of insulating foam in the form of a band of preset length and width and with a forward face sloped for a substantial part of the band width; spraying a second band of the liquid composition in a substantially similar predetermined pattern, length and width, as that of the prior layer, onto substantially all of the sloped forward face of the prior band to thereby deposit a sloped second foamed layer as a band on, and without significantly exceeding the height of, the first foamed band; and then applying a sloped third foam band to the second band in a similar manner followed by the consecutive application of additional sloped foam bands until an insulating bed comprising a multitude of sloped foam layers in the form of bands of substantially uniform height or thickness and length is deposited.

It is to be understood that the slope of the foam band faces and layers has reference to the surface on which the insulation is being deposited.

The liquid composition desirably is sprayed at a substantially uniform volume per band surface area. As a result, the liquid composition volume deposited will be substantially similar for all of the bands.

The bands deposited are substantially linear, and desirably straight, although they can be curvilinear.

The liquid composition is advantageously sprayed from a nozzle maintained a substantially prefixed distance from the surface. Furthermore, deposition of the insulating foam can be readily protected by use of a wind screen, thus permitting insulation on days when there is substantial wind blowing.

Each band can be deposited by starting spraying at one end and stopping spraying at the other end. All the bands can be deposited starting from the same end. Alternatively, deposit of every other band can start at an opposite end.

In general, while the nozzle deposits each band in a predetermined pattern, the nozzle is moved along a predetermined path normal to or at an oblique angle to the nozzle travel pattern. Desirably, the nozzle is moved at a substantially uniform speed along the predetermined path, which can be straight or curvilinear. In a more specific embodiment, the predetermined pattern of spraying is a substantially straight line and the nozzle is moved in a predetermined linear path which is, from one band to the next band, substantially normal to the straight line spraying pattern.

The nozzle is maintained a prefixed distance and desirably a uniform distance, from the surface during spraying.

The method of the invention is especially useful in depositing a foam layer or band less than 1 inch thick, about 0.5 to 2 feet wide and sloped at least 15°. Such bands can be as long as practical but usually will be from about 3 to 12 feet wide. The bed produced from such bands will, in vertical section, comprise at least four layers thick with each layer less than 1 inch thick.

Each insulating bed desirably has at least one sloped side. Two such beds positioned side-by-side with their sloped sides overlapping provides a substantially uniformly thick joint. Each bed can be a straight or curved run or strip.

DETAILED DESCRIPTION OF THE DRAWINGS

So far as it is practical, the same or similar elements or parts which appear in the various views of the drawings will be identified by the same numbers.

Figure 1:
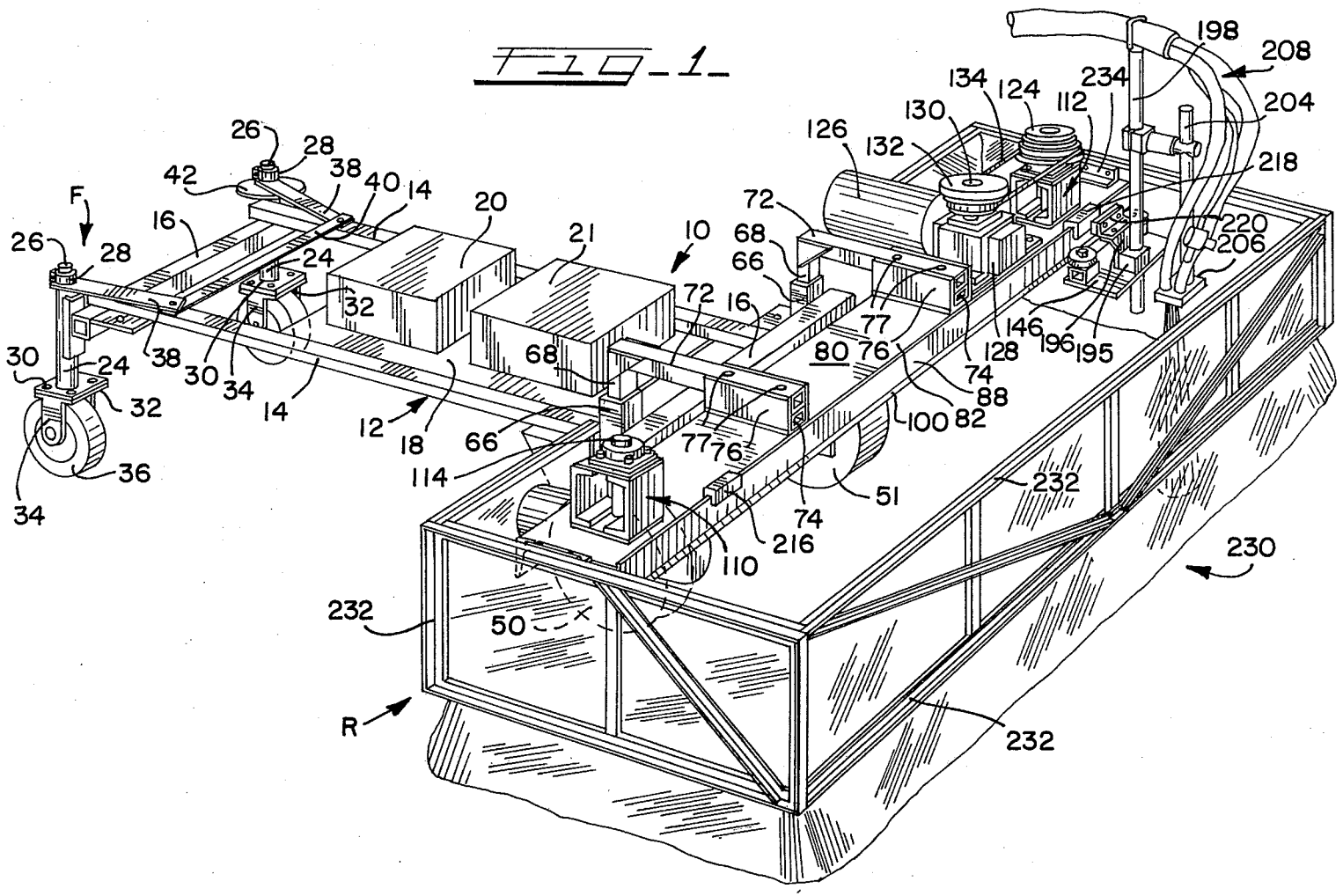
FIG. 1 is an isometric view of apparatus according to the invention, with a wind screen around the operating or front end, for depositing a bed of polymeric material on a surface.
Figure 2:
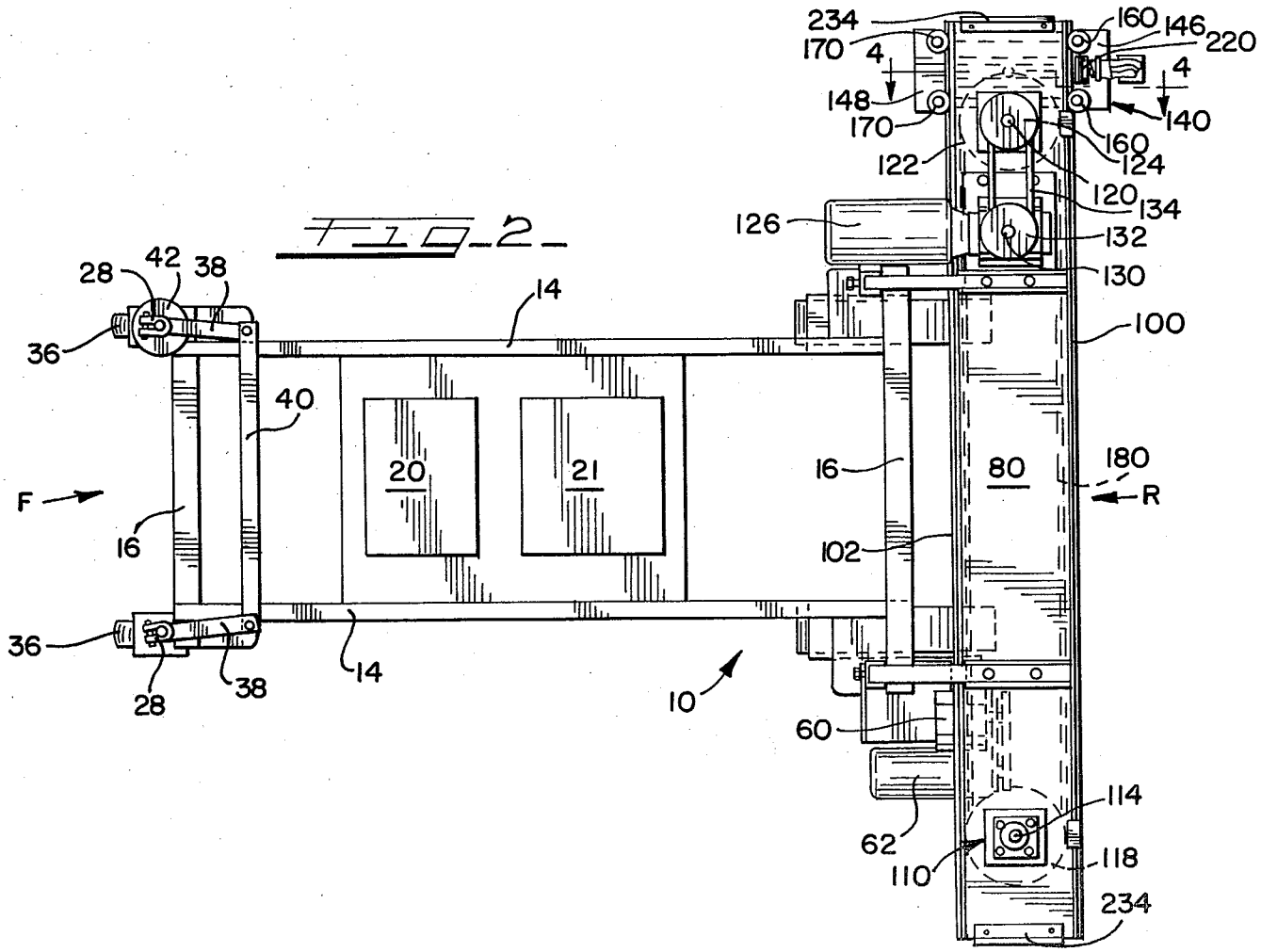
FIG. 2 is a plan view of the apparatus shown in FIG. 1.
Figures 3, 4:
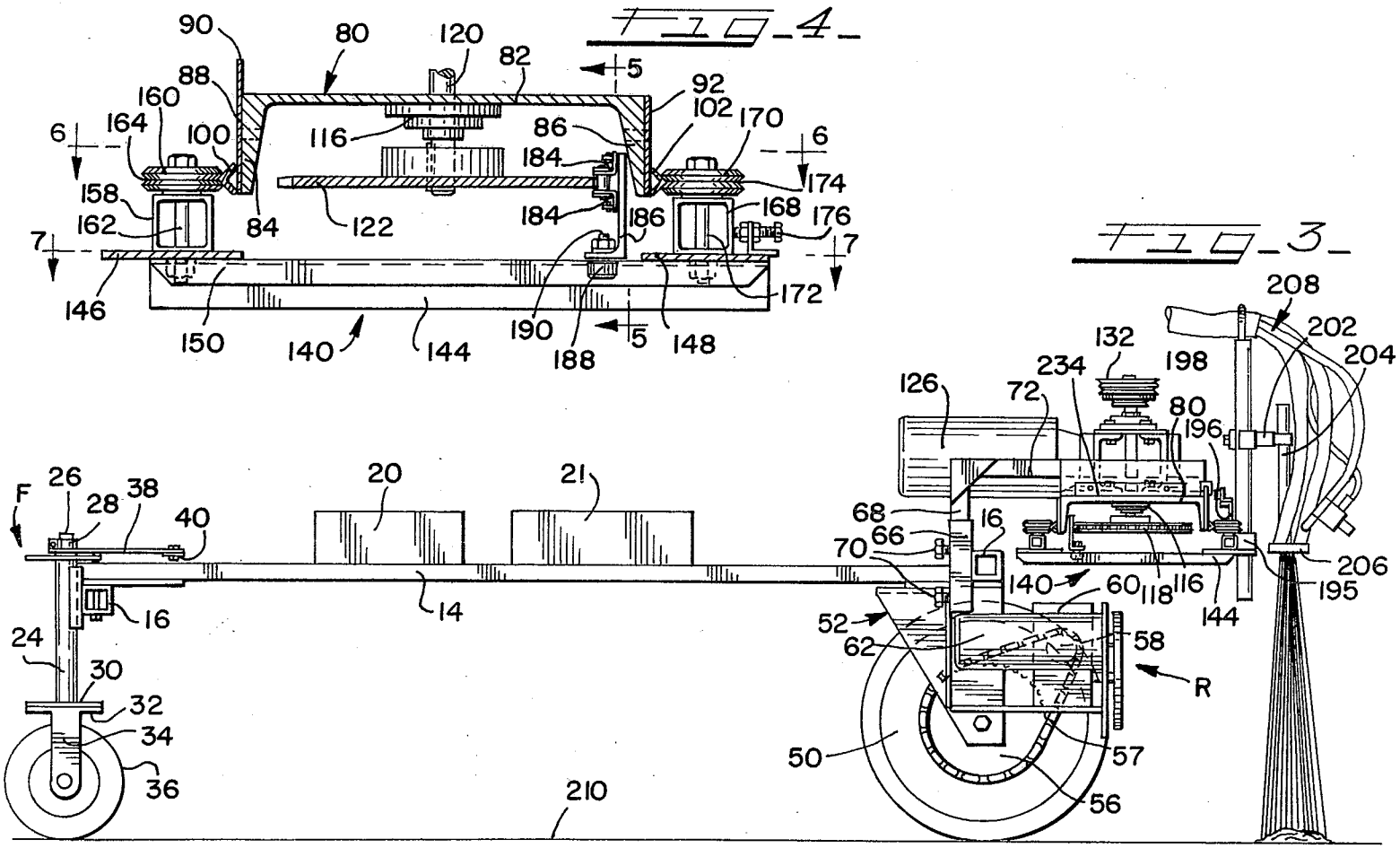
FIG. 3 is a side elevational view of the apparatus shown in FIGS. 1 and 2.
FIG. 4 is a sectional view taken along the line 4—4 of FIG. 2.
Figure 5:
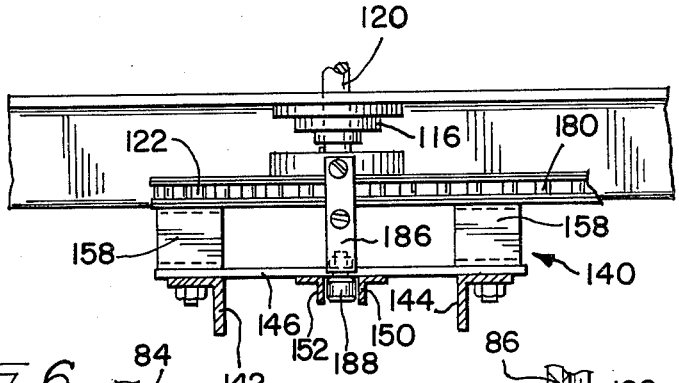
FIG. 5 is a sectional view taken along the line 5—5 of FIG. 4.
Figure 6:
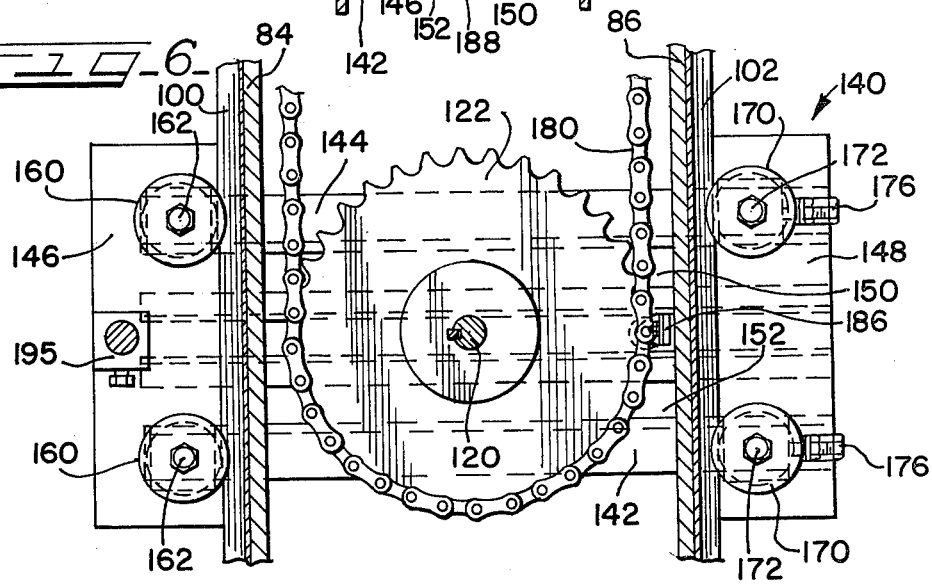
FIG. 6 is a sectional view taken along the line 6—6 of FIG. 4.
Figure 7:
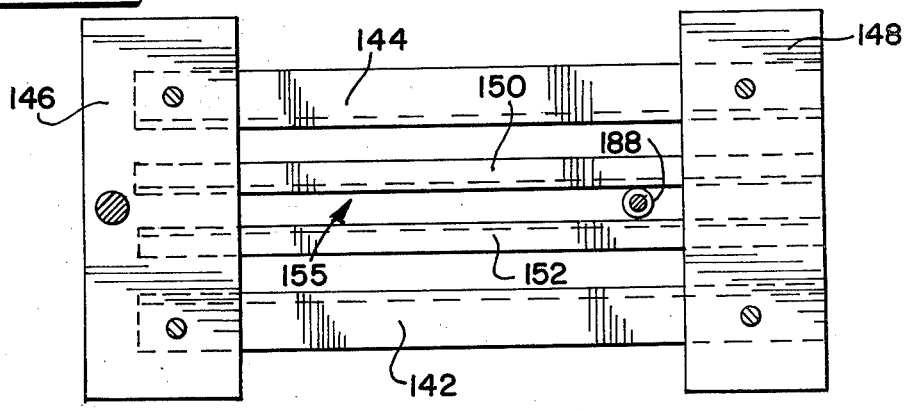
FIG. 7 is a sectional view taken along the line 7—7 of FIG. 4.

With reference to the drawings, and particularly to FIGS. 1 to 3, the polymeric insulating foam depositing apparatus 10 includes a rectangular frame 12 having a pair of spaced-apart parallel tubular side members 14 which are joined, about at their opposing ends, to the pair of parallel tubular cross members 16. A metal plate 18 extends between, and is joined to, the side members 14 and it provides a support for electrical control and circuit boxes 20 and 21.

The front end F of the apparatus 10 is steerably supported by a pair of wheels. Each of the two front corners of frame 12 has a vertical circular tube 24 joined to it. Each tube 24 contains a vertical shaft 26 rotatably secured therein by clamps 28. The lower end of each shaft 26 is joined to a horizontal plate 30 which is removably connected, such as by bolts, to a mating plate 32 beneath it. Two spaced-apart legs 34 depend from each plate 32 and a wheel 36 is mounted on an axle supported horizontally between each pair of adjacent legs 34. Rotation of each shaft 26 is controlled by a steering arm 38 which is joined to it beneath clamp 28. The outer ends of the two steering arms 38 are pivotally joined to the ends of connecting member 40. Steering of the apparatus is effected by applying manual force to either of the arms 38 or connecting member 40. Of course, steering can be mechanized or powered if desired but for most uses of the apparatus so little steering is required as to render manual operation preferable. Furthermore, when the apparatus is in use depositing an insulating foam bed, it is generally desirable to lock the steering mechanism to prevent it from directing movement of the apparatus out of a predetermined path. A means to lock the steering mechanism is accordingly provided. Thus, as shown in FIG. 1, a circular plate 42 is joined to one of the shafts 26 beneath, but adjoining, a steering arm 38. A conventional C-clamp can be used to releasably clamp plate 42 to the adjoining arm 38 with the wheels 36 located at any position within their angle of rotation.

The rear end R of the apparatus 10 is provided with a pair of spaced-apart non-steerable wheels 50 and 51 which rotate on horizontal axles mounted in wheel supports 52. Each wheel support 52 comprises a top horizontal plate, joined to the bottom of tubular side members 14. A pair of spaced-apart flanges depend downwardly from the top of each horizontal plate and each of the wheels 50 and 51 is positioned between a pair of such plates. Obviously, the wheels 50 and 51 can be mounted to the rear end R of frame 12 by other structural means known to skilled mechanics.

Wheel 50 constitutes a drive wheel for propelling the apparatus along a surface on which it is supported. A sprocket 56 is mounted on the same axle as that on which wheel 50 is mounted. An endless chain loop 57 is mounted on sprocket 56 and sprocket 58. Sprocket 58 is driven through a speed reducer 60 powered by a reversible and variable speed electric motor 62.

Two short square tubular vertically positioned members 66 are joined to the rear face of the rear tubular cross member 16. A tubular vertical leg 68 (FIGS. 1 and 3) is slidably secured inside of each tubular member 66 by bolt 70 (FIG. 3). An arm 72 extends horizontally rearwardly from the upper end of each leg 68 into contact with a short tubular member 74 joined to the top of horizontal channel member 80. A vertical plate 76 extends upwardly from the side of each short tubular member 74. The arms 72 fit snugly between the two pair of plates 76. Bolts 77 secure arms 72 and members 74 to channel member 80.

The horizontal channel member 80 is positioned laterally across the rear end of the apparatus and, with the wind screen 230 removed, is the widest part of the apparatus. Horizontal channel member 80 is positioned with the web 82 horizontal and with the flanges 84 and 86 depending downwardly from the web (FIG. 4). Horizontal channel 80 can be made of any suitable material but desirably is made of aluminum. A steel plate 88, as long as channel 80, is bolted to flange 84. The upper edge 90 of plate 88 extends above the top surface of web 82. A plate 92 is similarly bolted to flange 86 but the upper edge of plate 92 terminates at the top surface of web 82.

A rail 100 is formed along the lower horizontal edge of plate 88 by welding a structural steel angle to it. Similarly, a rail 102 is formed by welding a steel angle along the horizontal lower edge of plate 92. Each of the rails 100 and 102 extends for the length of horizontal channel member 80.

A bearing support 110 is located on top of, and near one end of, channel member 80. A similar bearing support 112 is located on top of, and near the other end of, horizontal channel member 80 (FIGS. 1 and 3). Shaft 114 is supported by both bearing support 110 and by a bearing support 116 mounted on the bottom of web 82. A sprocket 118 is securely mounted on the lower end of shaft 114, beneath web 82, so that it rotates with the shaft. A shaft 120 is supported in part by bearing support 112 and in part by a bearing support 116 mounted to the bottom of web 82. Sprocket 122 is mounted on the lower end of shaft 120 and rotates with it. A multistep pulley 124 is mounted on the top of shaft 120. Electric motor 126 is operatively engaged with speed reducer 128 mounted on the top of channel web 82. A driven shaft 130 projects upwardly from transmission 128 and has a multistep pulley 132 mounted on it. Belt 134 is positioned on pulleys 124 and 132 and it serves to transfer power from pulley 132 to pulley 124. Rotation of pulley 124 in turn drives sprocket 122.

The previously described rails 100 and 102 rollably support a carriage 140 (FIGS. 3 to 7). The carriage 140 includes two spaced-apart parallel structural angle members 142 and 144 which are bolted at their ends to laterally positioned plates 146 an 148. Two parallel but closely spaced apart structural angle members 150 and 152 (FIGS. 4 to 7) are also connected to plates 146 and 148, thereby defining a slot 155 which extends laterally beneath horizontal channel member 80.

Two short square tubular metal sections 158 are joined to the top of plate 146 and each tubular section 158 supports a roller 160 mounted on a vertical axle 162. Each roller 160 has a circumferential angled groove 164 adapted to ride on rail 100 and thus rollably suspend the adjacent end of carriage 140 from that rail. In addition, two short square tubular metal sections 168 are adjustably mounted on plate 148 and function as supports for rollers 170 which are mounted on axles 172. Each roller 170 contains a circumferential angled groove 174 which is adapted to ride on rail 102 and thus rollably suspend the adjacent end of carriage 140 from that rail. Adjusting bolts 176 are provided to obtain a suitable spatial relationship between the rails 100 and 102 and the rollers 160 and 170 which ride on those respective rails.

A chain loop 180 is mounted on sprockets 118 and 122. The chain loop 180 has a special link containing brackets 184 (FIGS. 4 and 5) which are bolted to a downwardly projecting leg 186. The lower end of leg 186 has a horizontal flange to which roller 188 is mounted by a suitable axle bolt 190. The roller 188 fits in slot 155 and it has a diameter very slightly smaller than the width of the slot. The roller 188 is displaced in the slot 155 for a distance somewhat greater than the diameter of sprockets 118 and 122.

Rolling reciprocal movement of the carriage 140 from one end of horizontal channel member 80 to the other end, and then back and forth thereon, is effected by means of drive sprocket 122 which moves chain 180 in a loop over the sprockets 118 and 122. As the chain travels, it carries with it roller 188 which, in turn, simultaneously moves the carriage 140 with it since roller 188 cannot escape from slot 155. The carriage moves at a uniform speed in both directions between the centers of sprockets 118 and 122. The direction of movement of the carriage 140 along the horizontal channel member 80 will correspond with the direction of movement of the special link in the chain 180 supporting roller 188. Since the two runs of the loop of chain between the sprockets 118 and 122 move in opposite directions, the carriage 140 will, accordingly, reverse direction as the special link travels from one side of the sprocket to the other side. Movement of the special link around the outer semicircular path traveled by the chain over either of the sprockets 118 and 122 results in a 180° change in direction of travel of the special link, as well as of roller 188 which causes the carriage to simultaneously reverse direction. Roller 188 in slot 155 functions, at this point, like a crankpin in an elongated frame to convert rotary motion to reciprocal motion as in a scotch yoke. Reciprocal movement of the carriage 140 is thereby effected after it travels for nearly the length of horizontal channel member 80.

A locking bracket 95 (FIGS. 3 and 6) is located in the front center of plate 146 and it is adapted to slidably and lockably receive a vertical rod 198. Bracket 202 is slidably and lockably mounted on rod 198. Rod 204 is vertically supported by bracket 202. The lower end of rod 204 supports a mixing or foaming nozzle 206 to which the components needed to create a polymeric insulating foam are supplied by the lines 208.

As the liquid stream of foaming material is sprayed from nozzle 206 it travels downwardly into contact with surface 210, on which the apparatus 10 rides, as the carriage 140 rolls along horizontal channel member 80.

Adjustable means are provided on the apparatus for starting and stopping foaming during reciprocal movement of carriage 140 to thereby regulate the length of the foam pass being deposited. As shown in the drawings, primarily FIGS. 1 and 2, a pair of electronic switches 216 and 218 are mounted on the upper edge 90 of plate 88. These switches are closed or opened, as is appropriate, by an electronic actuator 220 mounted on plate 196 of the carriage 140. By means of suitable electronic and electrical circuitry, the closing and opening of switches 216 and 218 results in activation or deactivation of foam spraying from nozzle 206. Switches 216 and 218 are desirably readily movable along plate 88 to thereby vary the length of the foam pass which is deposited.

A removable wind screen 230 (FIG. 1) can be mounted on the apparatus so as to provide a relatively quiescent air space over the surface to be insulated. The wind screen 230 consists of a framework of metal members 232 to which wood strips are secured by screws or other means. Flexible polymeric clear or translucent sheeting is tacked onto the wood strips along the sides of the framework. The sheeting is allowed to hang loosely downwardly from the bottom edge of the framework into movable contact with the surface being insulated and into contact with the foam bed deposited by operation of the apparatus. The wind screen 230 can be removably attached to the apparatus by angle supports 234 on the end of horizontal channel member 80. The wind screen is not used unless the wind current interferes with foam deposition. However, the wind screen permits foam deposition on windy days, which could not be done manually because an operator could not carry a wind screen and deposit foam at the same time.

Figure 9:
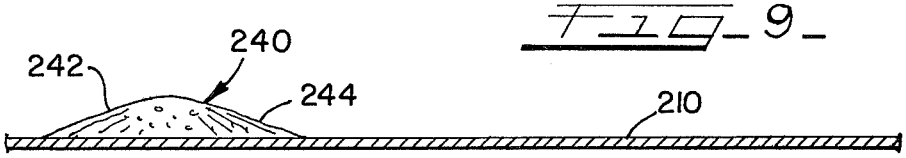
FIG. 9 is a sectional view taken along the line 9—9 of FIG. 8.

To deposit a bed of polymeric insulating foam, such as polyurethane foam, on a horizontal surface 210 (FIGS. 8 and 9), the apparatus is first properly positioned on the surface, the steering mechanism locked if desired, and the width of the foam pass set by proper positioning of switches 216 and 218. Reciprocal movement of carriage 140 is then initiated and a series of foam passes deposited one on top of the previous pass until a foam ridge 240 is formed having a height equal to that of the bed of foam to be deposited. Foam spraying nozzles generally deliver a larger amount of material in the center of the spray pattern so that a series of passes deposited sequentially one above the other will quickly lead to formation of the foam ridge. The foam ridge will have approximately similar downwardly sloping sides 242 and 244, and ends 246 and 248.

Figure 11:
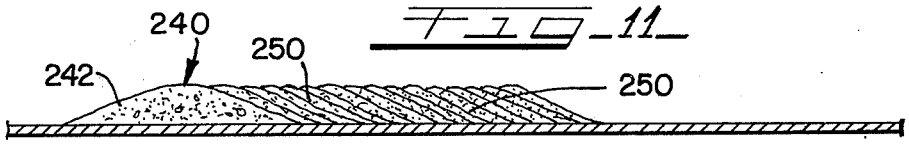
FIG. 11 is a sectional view taken along the line 11—11 of FIG. 10.
Figure 10:
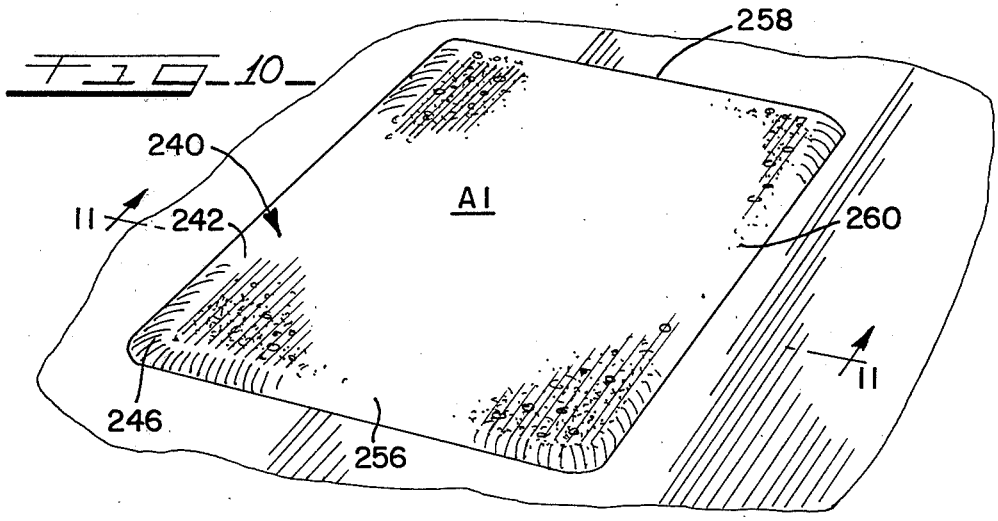
FIG. 10 is an isometric view of a bed of polymeric insulating foam deposited on a surface.

After the foam ridge 240 is deposited, power is supplied to drive wheel 50 to thereby propel the apparatus forward. Simultaneously, reciprocal movement of carriage 140 is initiated by supplying power to sprocket 122. As the carriage 140 moves reciprocally on horizontal channel member 80, liquid foam material is sprayed from nozzle 206 in sequential passes 250 onto surface 210 to form a bed as shown in FIGS. 10 and 11. Although each subsequent pass can begin at the end opposite that at which the previous pass began, it is usually satisfactory to start all the foam passes at the same end and to terminate them at the other end. As each foam pass is applied, it forms a sloping layer which can be 1 inch thick or greater, but which desirably is about 0.25 to 0.50 in. thick. The upper edge of each layer is about the same distance above the surface 210 so that a bed of uniform thickness is readily deposited. Each of the sloping layers is readily distinguishable since the layer boundaries are characterized by a thin skin 270, in a way similar to the rings of a tree. Pass after pass of foam is deposited until a bed of the desired length is obtained. The sides 256 and 258 of the bed A1 (FIG. 10) will slope downwardly, as will the bed end 260, unless means are used, such as a form, to obtain some other shape.

Figure 12:
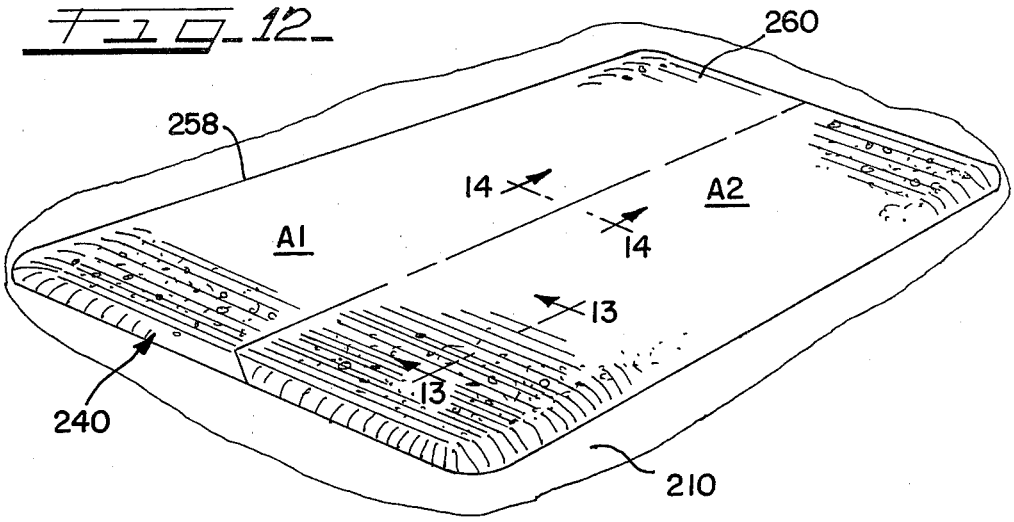
FIG. 12 is an isometric view of two side-by-side beds of insulating foam with adjacent sloped overlapping sides.
Figure 13:
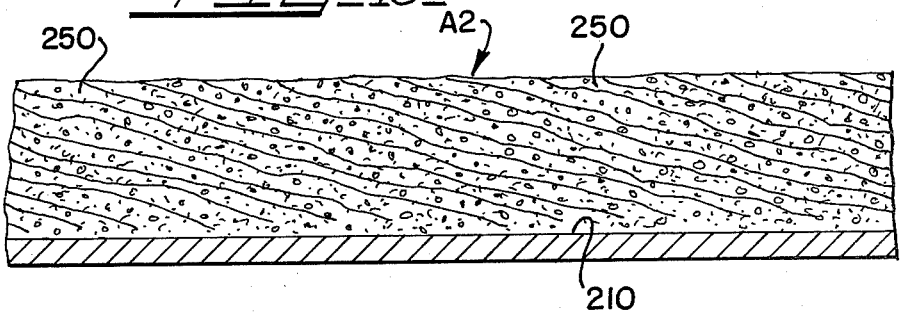
FIG. 13 is a sectional view taken along the line 13—13 of FIG. 12.
Figure 14:
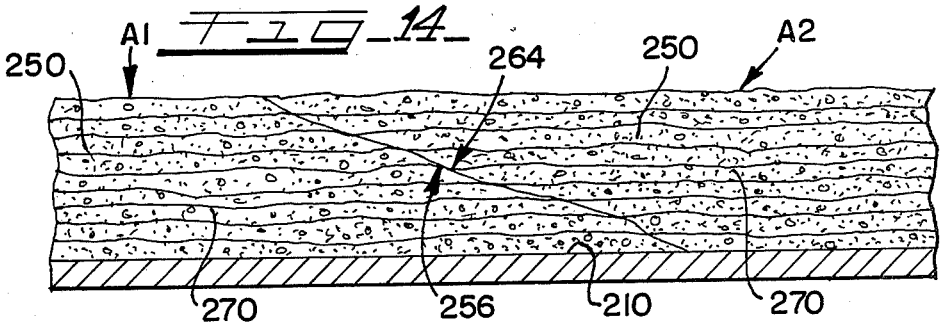
FIG. 14 is a sectional view taken along the line 14—14 of FIG. 12.

FIGS. 12 to 14 illustrate two similar foam beds A1 and A2 deposited side-by-side on surface 210. The sloped side 256 of bed A1 is overlapped by the reversibly sloped side edge 264 of bed A2. This results automatically since the side 264 of bed A2 is prevented from sloping downwardly by the supporting surface of side 256 of bed A1. Accordingly, the nature of the spray from nozzle 206 which results in sloped side 256 also causes a progressively reduced foam deposition moving upwardly on sloped surface 256. The result is an overlapped foamed area of substantially uniform thickness.

FIG. 14 shows that the foam passes 250, when viewed in section parallel to the direction in which the passes are deposited, have dividing skins 270 which, even though wavy, are generally horizontal. However, FIG. 13, which is a sectional view taken lateral to the foam passes, shows the dividing skins 270 as sloped.

Figure 15:
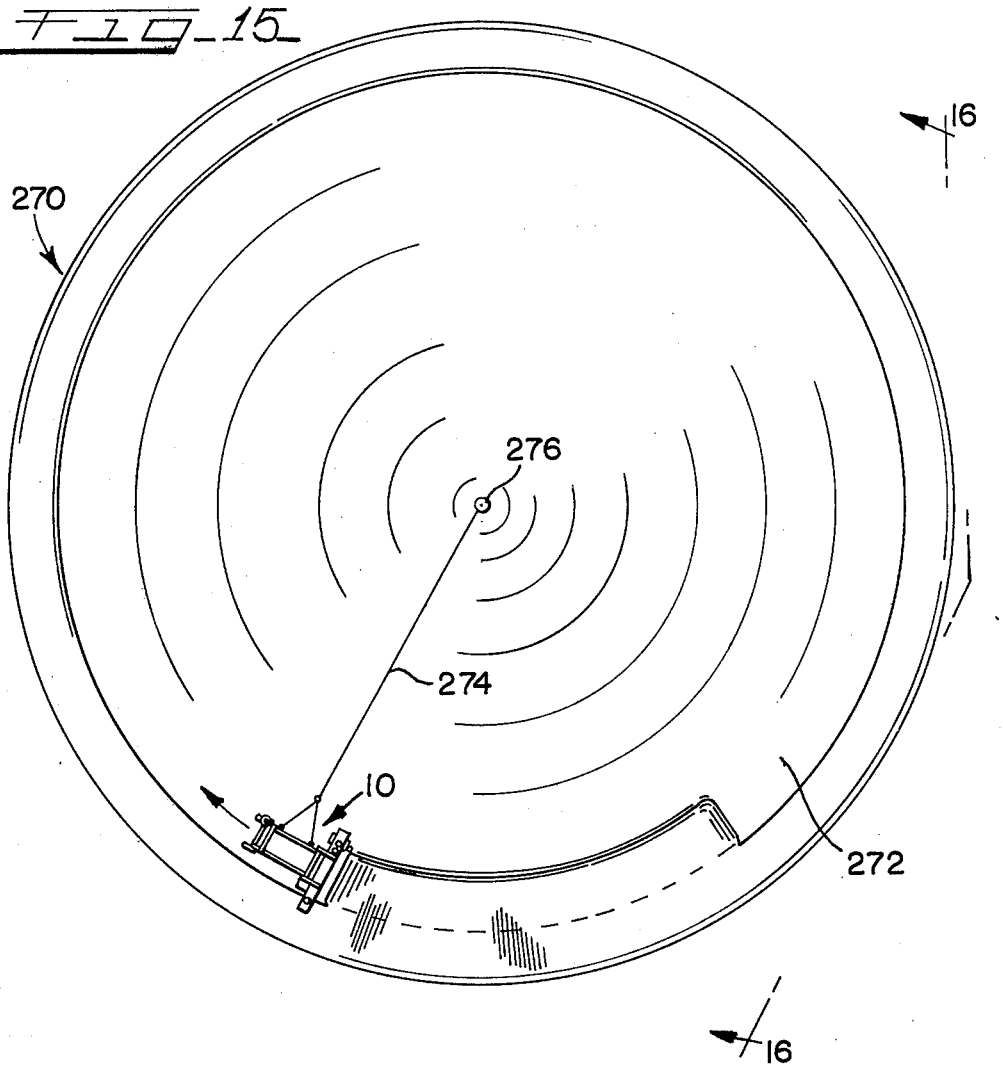
FIG. 15 is a plan view of a cone roof cylindrical storage tank showing the apparatus of FIGS. 1 to 7 used to insulate the roof.
Figure 16:
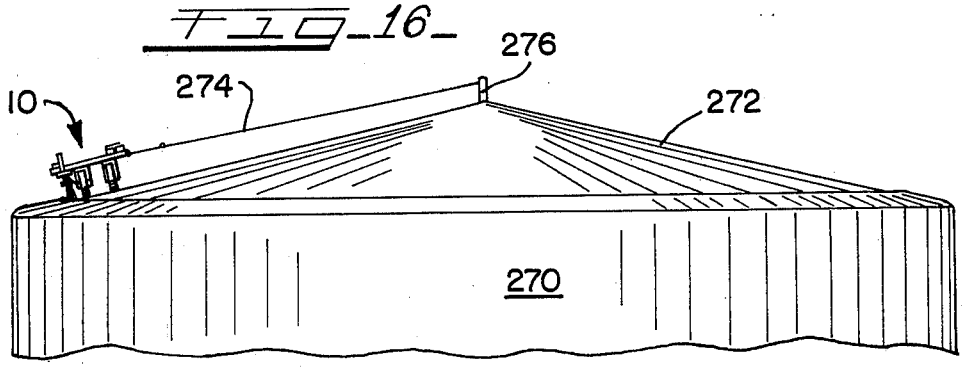
FIG. 16 is an elevational view taken along the line 16—16 of the upper part and roof of the tank shown in FIG. 15.

FIGS. 15 and 16 illustrate how the apparatus 10 shown in FIGS. 1 to 7 can be used to apply foam insulation on the roof of a tank 270, which in this case is a conical roof 272. After the apparatus is placed on the roof 272, an adjustable tethering line 274 is run from a mooring post 276, located at the apex of the roof, to the radially inward side of the apparatus 10. Generally the apparatus will be positioned initially near the roof edge so that insulating foam rings can be deposited one after the other progressively or radially inwardly. The steering mechanism of the apparatus is then locked in place with the front wheels positioned to turn the apparatus in a circle slightly greater than the tethering line 274 will permit the apparatus to turn. This causes the apparatus to continuously try to move outwardly, thereby placing the line 274 under tension, and prevents the apparatus from turning in a circle smaller than desired.

Figure 8:
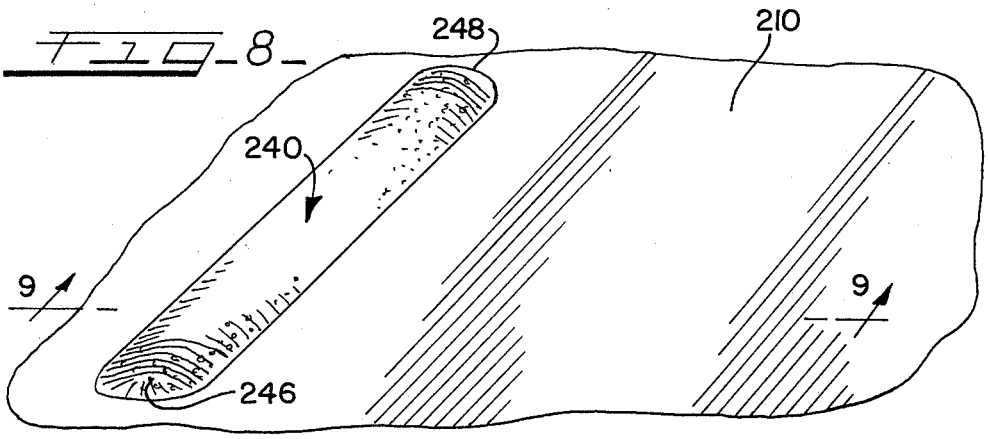
FIG. 8 is an isometric view of a foamed ridge applied to a surface as a starting dimensional guide and mold.

Once the apparatus is in place on the roof and prepared as described, a starting radial foam ridge, like ridge 240 in FIG. 8, is deposited. Then drive wheel 50 is activated to move the apparatus ahead in a circular path while, simultaneously, carriage 140 is placed in reciprocal movement and liquid foam is sprayed from nozzle 206 in a series of passes which are deposited as sequential sloped layers. After a complete ring of foamed insulation is deposited as described, the apparatus is repositioned, by adjusting tethering line 274, so that it can deposit the next foam ring next to the previously deposited ring but with the adjacent edges overlapping in the manner shown in FIGS. 12 and 14. Insulating foam rings are deposited as described until there is insufficient room for the apparatus 10 to rotate and deposit foam rings. The apparatus may then be used to deposit a straight bed of foam over the top portion of the tank with any remaining gaps filled by manual foam application. Alternatively, after the apparatus has deposited the smallest foam ring which it can deposit, the apparatus can be removed and then the circular space at the top can be insulated by the manual application of spray applied foam.

It is, of course, not essential that foam rings be deposited on a tank roof beginning at the edge and moving radially inwardly ring by ring since a radially outward deposition of the rings is also feasible. Furthermore, it is not essential that the rings be initially deposited side-by-side with overlapping adjacent edges. The foam rings can be deposited with gaps between them and later the apparatus can be used to fill the gaps with foam or the gaps can be filled by manual foam spraying.

The apparatus of the invention can be used to deposit polymeric insulating foam 6 inches thick, or even thicker, in a single pass. In addition, multi-bed insulation can be deposited by placing one or more subsequent beds on a previously deposited bed. Reinforcing cloth, such as fiberglass, can be placed between the beds if the insulation is for cryogenic applications.

Although the horizontal channel member 80 is shown in the drawings positioned lateral to the apparatus, it may be desirable for member 80 to be mounted on the apparatus at an oblique angle to the longitudinal axis of the apparatus. When so mounted, the carriage 140 will reciprocate, and the foam passes will be deposited, at the same oblique angle.

It is also feasible for member 80 to be made curvilinear so that the foam passes can be deposited as arcs or ring segments.

The foregoing detailed description has been given for clearness of understanding only, and no unnecessary limitations should be understood therefrom, as modifications will be obvious to those skilled in the art.

What is claimed is:

1. A method of applying a bed of polymeric insulating foam which comprises:

spraying by means of a nozzle a liquid composition, which quickly expands and sets into a dry polymeric insulating foam, in a predetermined pattern of travel onto a horizontal or sloped surface to thereby deposit a layer of insulating foam in the form of a band of preset length and width and with a forward face sloped for a substantial part of the band width;

spraying a second band of the liquid composition in a substantially similar predetermined pattern, length and width, as that of the prior layer, onto substantially all of the sloped forward face of the prior band to thereby deposit a sloped second foamed layer as a band on, and without significantly exceeding the height of, the first foamed band; and then applying a sloped third foam band to the second band in a similar manner followed by the consecutive application of additional sloped foam bands until an insulating bed comprising a multitude of sloped foam layers in the form of bands of substantially uniform height or thickness and length is deposited.

2. A method according to claim 1 in which the liquid composition is sprayed at a substantially uniform volume per band surface area.

3. A method according to claim 2 in which the liquid composition volume deposited is substantially similar for all of the bands.

4. A method according to claim 1 in which the bands are substantially linear.

5. A method according to claim 4 in which the bands are substantially straight.

6. A method according to claim 1 in which the liquid composition is sprayed from a nozzle maintained a substantially prefixed distance from the surface.

7. A method according to claim 6 in which the predetermined pattern of spraying is linear.

8. A method according to claim 6 in which the predetermined pattern of spraying is a straight line.

9. A method according to claim 1 in which each band is deposited by starting spraying at one end and stopping spraying at the other end.

10. A method according to claim 9 in which all bands are deposited starting from the same end.

11. A method according to claim 1 in which deposit of every other band starts at an opposite end.

12. A method according to claim 1 in which, while the nozzle deposits each band in a predetermined pattern, the nozzle is moved along a predetermined path normal to or at an oblique angle to the nozzle travel pattern.

13. A method according to claim 12 in which the nozzle is moved at a substantially uniform speed along the predetermined path.

14. A method according to claim 13 in which the predetermined path is curvilinear.

15. A method according to claim 13 in which the predetermined path is straight.

16. A method according to claim 12 or 13 in which the predetermined pattern of spraying is a substantially straight line and the nozzle is moved in a predetermined linear path which is, from one band to the next band, substantially normal to the straight line spraying pattern.

17. A method according to claim 16 in which the nozzle is maintained a prefixed distance from the surface.

18. A method according to claim 16 in which the nozzle is maintained a uniform distance from the surface.

19. A method according to claim 1 in which the surface on which the insulating foam is being deposited is protected against the action of the wind by a wind screen.

20. A method according to claim 1 in which each foam layer or band is less than 1 inch thick, about 0.5 to 2 feet wide and is sloped at least 15°.

21. A method according to claim 1 in which the bed in vertical section comprises at least four layers and each layer is less than 1 inch thick.

22. A method according to claim 1 in which two beds are positioned side-by-side, each insulating bed has at least one sloped side and the sloped sides overlap and form a substantially uniformly thick joint.

23. A method according to claim 22 in which each bed is straight or curved.

* * * * *

UNITED STATES PATENT AND TRADEMARK OFFICE

CERTIFICATE OF CORRECTION

PATENT NO. : 4,333,973

DATED : June 8, 1982

INVENTOR(S) : Francis V. Bellafiore et al

It is certified that error appears in the above-identified patent and that said Letters Patent are hereby corrected as shown below:

Column 6, line 18, change "an 148" to --and 148--; column 7, line 8, change "95" to --195--.

Signed and Sealed this

*Third* Day of *August 1982*

[SEAL]

*Attest:*

GERALD J. MOSSINGHOFF

*Attesting Officer*

*Commissioner of Patents and Trademarks*